US008646361B2

(12) United States Patent
Minnette et al.

(10) Patent No.: US 8,646,361 B2
(45) Date of Patent: Feb. 11, 2014

(54) DEVICE FOR OPENING CONTAINER CLOSURES

(76) Inventors: Jeffrey Minnette, Evansville, IN (US); Randall Julian, Spurgeon, IN (US)

( * ) Notice: Subject to any disclaimer, the term of this patent is extended or adjusted under 35 U.S.C. 154(b) by 310 days.

(21) Appl. No.: 12/723,208

(22) Filed: Mar. 12, 2010

(65) Prior Publication Data

US 2010/0229689 A1 Sep. 16, 2010

Related U.S. Application Data

(60) Provisional application No. 61/160,049, filed on Mar. 13, 2009.

(51) Int. Cl.
*B67B 7/14* (2006.01)

(52) U.S. Cl.
USPC ..... 81/3.55; 7/105

(58) Field of Classification Search
USPC ..... 81/3.55, 3.09, 3.36, 3.57, 3.07, 3.47, 81/3.4, 3.42; 7/105, 151, 166, 169
See application file for complete search history.

(56) References Cited

U.S. PATENT DOCUMENTS

| | | | | | |
|---|---|---|---|---|---|
| 471,562 | A | | 3/1892 | Minnerly | |
| 597,286 | A | * | 1/1898 | Horswill, Jr. | 81/3.55 |
| D34,096 | S | * | 2/1901 | Stephens | 81/3.55 |
| 684,825 | A | | 10/1901 | Johnson | |
| 1,453,956 | A | | 5/1923 | Smith | |
| 1,793,907 | A | * | 2/1931 | Clarke et al. | 254/131 |
| 1,826,740 | A | | 10/1931 | Courtney | |
| 1,963,007 | A | | 6/1934 | Week | |
| 2,603,991 | A | | 7/1952 | Oliver | |
| 2,675,721 | A | * | 4/1954 | Kramer et al. | 81/3.55 |
| 2,931,259 | A | * | 4/1960 | Nicot | 81/3.55 |
| 4,397,404 | A | | 8/1983 | Blanchette | |
| 4,580,302 | A | | 4/1986 | Barth | |
| 4,586,404 | A | | 5/1986 | Ginther | |
| 4,631,769 | A | | 12/1986 | White | |
| 4,658,455 | A | | 4/1987 | Skillern | |
| 4,667,843 | A | | 5/1987 | Galer | |
| 4,813,120 | A | * | 3/1989 | Fournier | 7/169 |
| 5,018,409 | A | | 5/1991 | Bittel | |
| 5,069,090 | A | | 12/1991 | Clark | |
| 5,127,121 | A | | 7/1992 | Bossie | |
| 5,212,869 | A | * | 5/1993 | Zacharchuk | 81/3.55 |
| 6,105,468 | A | | 8/2000 | Fohrman et al. | |
| 6,199,452 | B1 | | 3/2001 | Vinar | |
| 6,311,580 | B1 | * | 11/2001 | Nagy | 81/3.55 |

(Continued)

*Primary Examiner* — Hadi Shakeri
(74) *Attorney, Agent, or Firm* — C. Richard Martin

(57) ABSTRACT

A device of opening container closures of the type including a circular seal to container opening and a continuous, circular flange and the container including an opening with an inner wall, such as is commonly found in paint containers is provided. The device for opening container closures includes an elongated handle portion connected to an opener portion. The opener portion extends from a first end of the handle portion and includes a pry edge located at a free end thereof. The opener portion further includes an inner cam surface defined by a first radius from a center of rotation for the opening device. The inner cam surface is provided on an upper surface of the opener portion and extends from the pry edge toward the first end of the handle portion. The opener portion also includes an eccentric outer cam surface defined by a second radius from a second center of rotation for the opening device. The eccentric outer cam surface is provided on a lower surface of the opener portion and extends from the pry edge toward the first end of the handle portion.

11 Claims, 10 Drawing Sheets

(56) References Cited

U.S. PATENT DOCUMENTS

| | | | | |
|---|---|---|---|---|
| 6,421,860 | B1 | 7/2002 | Abbott | |
| 6,578,223 | B1 | 6/2003 | Link et al. | |
| 6,865,761 | B2 | 3/2005 | Henke et al. | |
| 6,964,348 | B2 | 11/2005 | Breimon et al. | |
| 7,313,983 | B1 | 1/2008 | Book | |
| 2006/0179978 | A1 * | 8/2006 | Rocks | 81/3.55 |

* cited by examiner

DEVICE FOR OPENING CONTAINER CLOSURES

FIELD OF THE INVENTION

The invention relates to devices for opening container closures, and specifically relates to an opener for removing tight fitting, removable container closures, the closures being of the type including a circular seal to container opening and a continuous, circular flange and the container including an opening and a container rim with inner wall, such as is commonly associated with paint cans.

BACKGROUND OF THE INVENTION

Various types of leverage devices have been proposed for removing lids from containers such as paint cans. Most of these devices are flat and thin-bladed metal objects that are used to pry lids from the metal sealing channel of the paint can. However, with the recent trend toward all plastic paint containers such as is disclosed in U.S. Pat. No. 6,964,348, problems have arisen when prior art opening devices have been used. The sharp edges of the flat, thin-bladed metal openers can dig into and permanently deform the outer edges of the lid and the container rim creating opportunities for the seal to be compromised. Where metal lids and rim assemblies have been used in the past, friction between the annular rings of the lid and rim assembly maintain closure of the lid on the container. In the new, all plastic containers, a snap-fit between a locking notch on the lid and corresponding locking tab on the rim assembly is used to maintain closure. When opening the all plastic container, there is not a gradual release as was previously experienced when opening a metal lid/can held in place by friction. Rather, force is exerted on the plastic material causing it to flex until the notch and tab are separated and the closure pops open. Thus, in order to effectuate opening of a plastic lid/rim assembly, an additional radial inward force is needed to temporarily deform the plastic material of the lid and/or rim to effectuate disengagement of the notch and tab. In addition, it is necessary to provide significantly more vertical lift than was associated with metal lid/rim assemblies due to the snap-fit of the lid and rim.

SUMMARY OF THE INVENTION

The present invention overcomes these limitations by providing an opening device that can be used to open a container having a plastic lid and rim assembly without permanently damaging the lid and rim. The opener of the present invention also utilizes a pair of unique cam surfaces to smoothly and effectively provide the radially inward force needed to deflect the plastic material of the lid and rim while simultaneously providing the needed upward force to separate the notch and tab.

According to one aspect of the present invention, there is provided a device for opening container closures comprising an elongated handle portion connected to an opener portion. The elongated handle portion includes a first end and a second end. The opener portion extends from the first end of the handle portion and includes a pry edge located at a free end thereof. The opener portion further includes an inner cam surface defined by a first radius from a center of rotation for the opening device. The inner cam surface is provided on an upper surface of the opener portion and extends from the pry edge toward the first end of the handle portion. The opener portion also includes an eccentric outer cam surface defined by a second radius from a second center of rotation for the opening device. The eccentric outer cam surface is provided on a lower surface of the opener portion and extends from the pry edge toward the first end of the handle portion.

According to a further aspect of the present invention, the elongated handle portion and opener portion are a unitary piece of material. The unitary handle portion and opener portion may be formed from a plastic material having a tensile strength of at least fifteen thousand pounds per square inch (15,000 psi). According to one presently preferred embodiment of the invention, the plastic material is 30% glass-filled nylon.

Yet another aspect of the present invention is to provide a widened region of the elongated handle portion proximal to the first end thereof. Gripping means may further be provided on a surface of the elongated handle portion in the widened region. According to one presently preferred embodiment of the invention, the gripping means may include a plurality of ridges protruding from an upper surface of the elongated handle portion in the widened region.

A further aspect of the invention provides that the eccentric outer cam surface projects below a lower surface of the opener portion forming a hump. A fulcrum point is preferably located at a point where the lower surface of the opener portion meets a second end of the eccentric outer cam surface.

These and other objects, features and advantages of the present invention will become apparent with reference to the text and the drawings of this application.

DETAILED DESCRIPTION OF PREFERRED EMBODIMENTS

Figure 1:
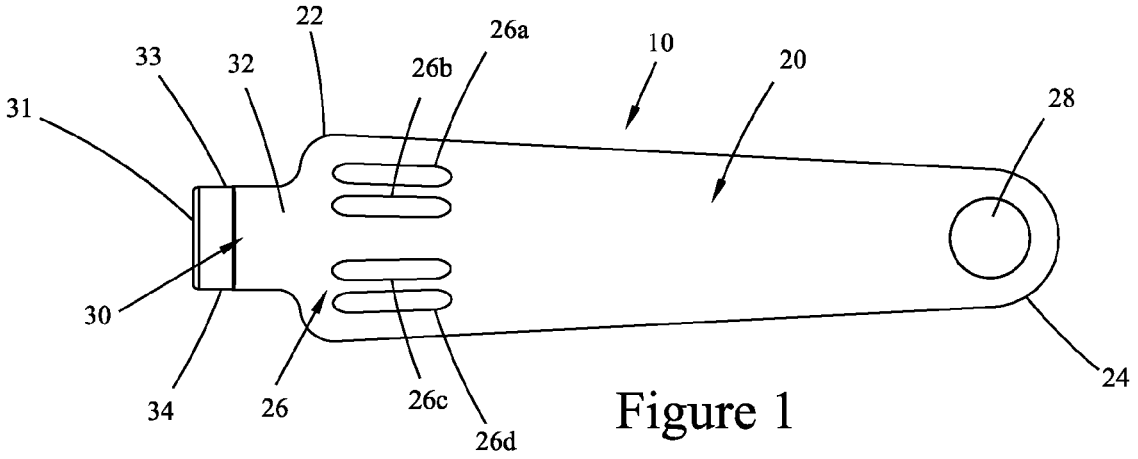
FIG. 1 is top plan view of a device for opening container closures according to one preferred embodiment of the present invention.
Figure 2:
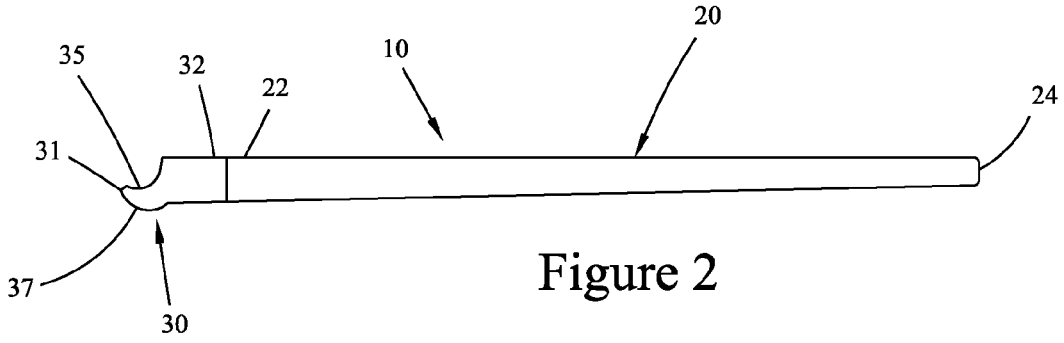
FIG. 2 is a side plan view of the device for opening container closures shown in FIG. 1.
Figure 3:
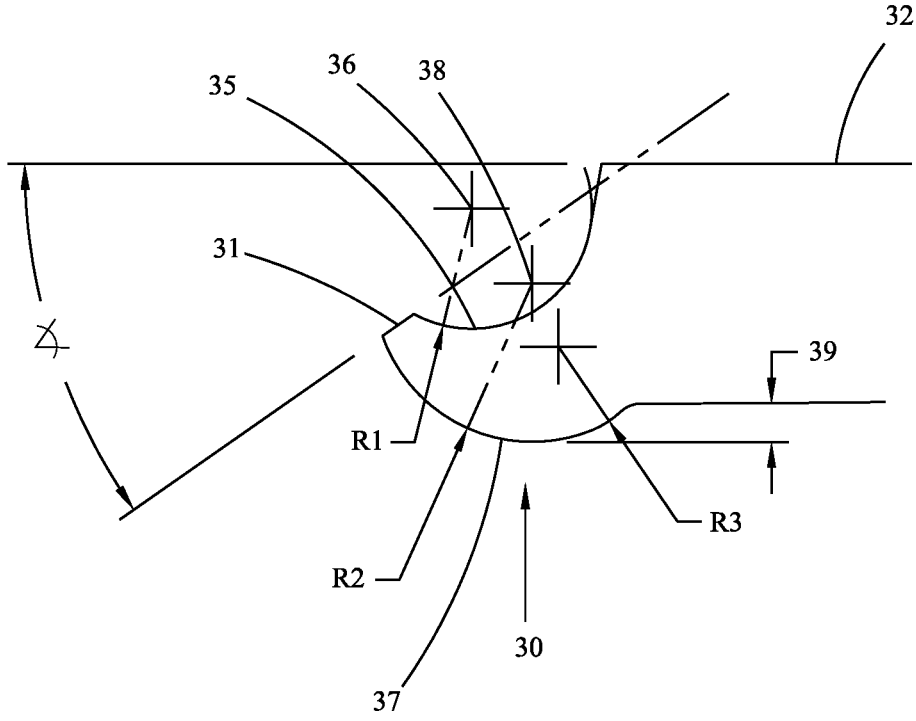
FIG. 3 is an enlarged, detailed side view of the tip portion of the device for opening container closures shown in FIGS. 1 and 2.

FIGS. 1-3 illustrate a container closure opening device 10 according to a presently preferred embodiment of the present invention. According to the presently preferred embodiment, the opening device 10 includes a handle portion 20 and an opener portion 30. A first end 22 of the handle 20 is joined to a second end 32 of the opener portion 30. Preferably, the handle 20 and opener 30 comprise a one-piece integral unit as shown in FIGS. 1 & 2. According to one presently preferred aspect of the invention, the handle 20 and opener 30 are formed of a plastic material. Because the molding process lends itself to cost effectively producing a tool that does not have sharp edges, plastic is the preferred material for the opening device 10. The plastic material should also be of sufficient strength and rigidity to resist breakage or significant bending when the lever is used to pry the lid off of the container. It has been found that using a material having a tensile strength of at least fifteen thousand pounds per square inch (15,000 psi) provides enough strength to the opening device 10 to withstand fracture and significant bending under most circumstances. One presently preferred material that meets these tensile strength characteristics and has proven to be soft enough to avoid marring of the plastic surface of the lid and rim assembly is 30% glass-filled nylon.

The handle portion 20 includes a first end 22 and a second end 24. Gripping means, such as the protruding ridges 26*a*, 26*b*, 26*c*, 26*d* shown in FIG. 1 may also be provided. Hanging means, such as opening 28 formed in the handle 20 proximal to the second end 24 may also be provided to facilitate easy storage and retrieval of the opener 10. As best shown in FIG. 1, the first end 22 of the handle 20 may include a widened region surrounding the gripping means 26 to provide greater leverage for twisting of the tool to effect complete opening of the container. According to one presently preferred embodiment, the first end 22 of the handle 20 is 1.125 inches wide at the point where the gripping means 26 is located to facilitate turning of the opener 10 in the final step of opening the container.

The opener portion 30 includes a first end or pry edge 31 and a second end 32 that is integral to the first end 22 of the handle 20. The opener portion 30 also includes a first side edge 33 and second side edge 34 defining the width of the opener portion 30. On the upper side of the opener portion 30 there is provided an inner cam surface 35, that, in operation, engages the outer edge of the lid to effect removal thereof. The shape of the inner cam surface 35 is determined by the distance of the radius R1 from the center of rotation 36 of the inner cam surface to the inner cam surface 35 itself. According to a presently preferred embodiment, the radius R1 is approximately 0.125 inches. The lower side of the opener portion 30 is similarly provided with an eccentric outer cam surface 37 that engages the outer rim of the container during the lid removal process. The shape of the eccentric outer cam surface is determined by the distance of the radius R2 from the center of rotation 38 of the outer cam surface to the outer cam surface 37 itself. According to a presently preferred embodiment, the radius R2 is approximately 0.165 inches. It is important to note that the different radii R1 & R2 swing from different centers 36, 38, thereby defining the degree of eccentricity in the outer cam surface 37. As best shown in FIG. 3, the eccentric outer cam surface 37 projects below the bottom edge of the handle portion 20 to form a hump 39, which is essential in facilitating the removal of the lid. According to a presently preferred embodiment, the hump 39 projects approximately 0.100 inches below the bottom surface of the handle portion 20. The first end or pry edge 31 of the opener section 30 has a blunt end so as not to cause it to permanently deface the plastic lid when it is pressed into engagement therewith. According to one preferred embodiment of the present invention, the pry edge 31 has a width of 0.040 inches along the cross section shown in FIG. 3.

FIGS. 4-10 illustrate the use of a container closure opening device 10 according to a presently preferred embodiment of the present invention being used to remove the lid 40 from a container 50. The lid 40 and container 50 shown in FIGS. 4-10 may be formed of plastic, such as would be used in a plastic paint can as described in connection with U.S. Pat. No. 6,964,348. The lid 40 includes a central planar section 41 having an outer edge structure in the form of a downwardly facing, continuous, annular channel 42. The channel 42 has a generally vertical inner wall 43 connecting with a roof portion 44 that slopes outwardly and downwardly along an outer wall 45 having an inwardly extending locking notch 46. The outer wall 45 has an outer annular shoulder 47 projecting radially outwardly therefrom. The container 50 includes a cylindrical main body 51 and a circumferential rim assembly 52. The rim assembly 52 includes an upwardly facing, continuous, annular open channel 53 that is formed along a radially inner-most edge by a flexible finger 54. The upper end of the flexible finger 54 is provided with an outwardly protruding locking tab 55. The lower end of the flexible finger 54 slopes outwardly and downwardly into a base 56 which defines a bottom of the channel 53. An outer edge of the channel 53 includes a sidewall 57 which rises upwardly from the base 56 opposite the flexible finger 54. A generally horizontally extending connector 58 joins the upper end of the sidewall 57 with an outer peripheral edge 59 which defines the radially outermost structure of the rim assembly 52. The outer peripheral edge 59 is connected to an inner wall 60 by a top surface 61 of the rim assembly 52. While the container closure opening device 10 is particularly suited for use in association with plastic paint cans of this type, it can also be used in conjunction with metal paint cans and lids as are commonly known in the art.

Figure 4:
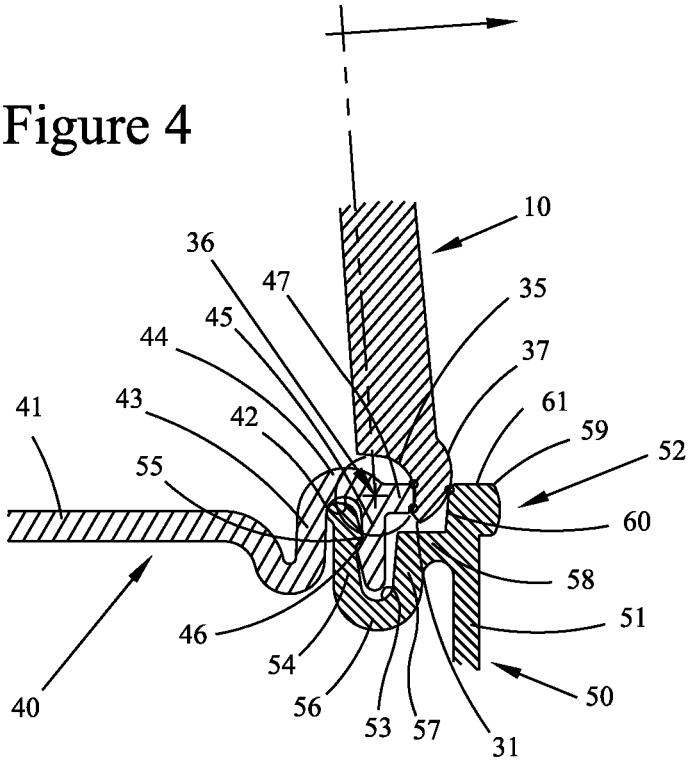
FIG. 4 is a side cross section view of the device for opening container closures shown at the moment of insertion between the container and lid.

As shown in FIG. 4, the pry edge 31 of the container closure opening device 10 is inserted into the opening between the outer annular shoulder 47 of the lid 40 and the inner wall 60 of the rim assembly 52 such that the opener 10 rests on three points of contact. Specifically, the inner cam surface 35 of the opener 10 engages the outer annular shoulder 47 of the lid 40 at two distinct locations as shown in FIG. 4. The outer eccentric cam surface 37 engages the inner wall 60 of the rim assembly 52 at one location. When fully inserted into the opening, the opener 10 comes to rest within approximately 5 degrees of vertical, depending upon the exact container/lid fit dimensions.

Figure 5:
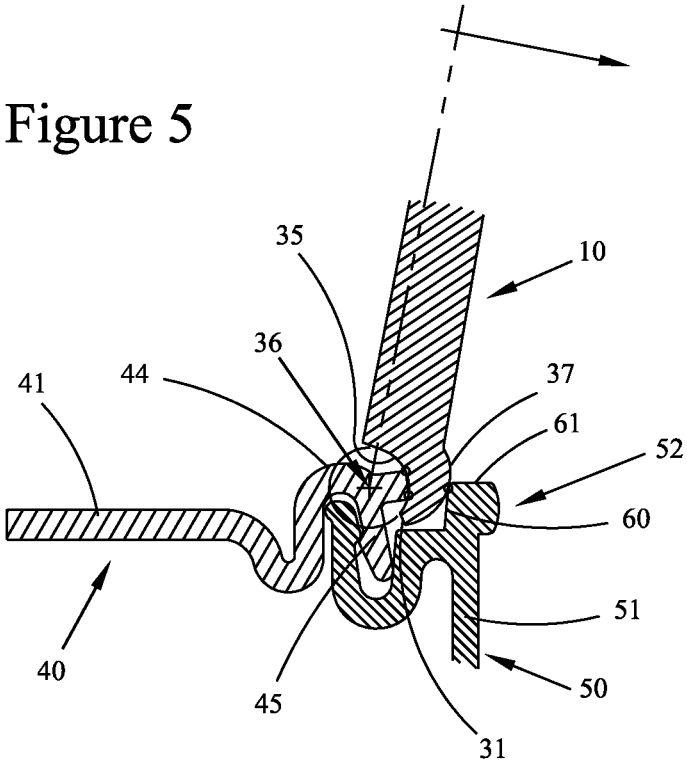
FIG. 5 is a side cross section view of the device for opening container closures shown after approximately 15 degrees rotation of the opener handle.

After the opener 10 is inserted into the opening between the lid 40 and container 50 as shown in FIG. 4 and described above, the operator then applies downward and outward pressure on the second end 24 of the handle 20. FIG. 5 shows the condition of the lid 40 and container 50 and the positioning of the opener 10 in relation thereto, after the opener has been rotated approximately 15 degrees about the effective center of rotation, which corresponds approximately with the center of rotation 36 of the inner cam surface 35. As can be seen in FIG. 5, the plastic lid flange begins deflecting in the area between the roof 44 and outer wall 45, proximal to the outer annular shoulder 47. The contact points of the outer annular shoulder 47 to the inner cam surface 35 move upwardly along the inner surface, as does the contact point of the rim assembly 52 to the outer cam surface 37. By rotating the opener 10 around the approximate center 36 of the inner cam surface 35, a primarily horizontal force is exerted against the lid flange thereby beginning to spread the width of the annular channel 42. At this point, a much smaller vertical lifting force is beginning to push upward on the lid 40 to begin to effect disengagement of the inwardly extending locking notch 46 from the outwardly protruding locking tab 55.

Figure 6:
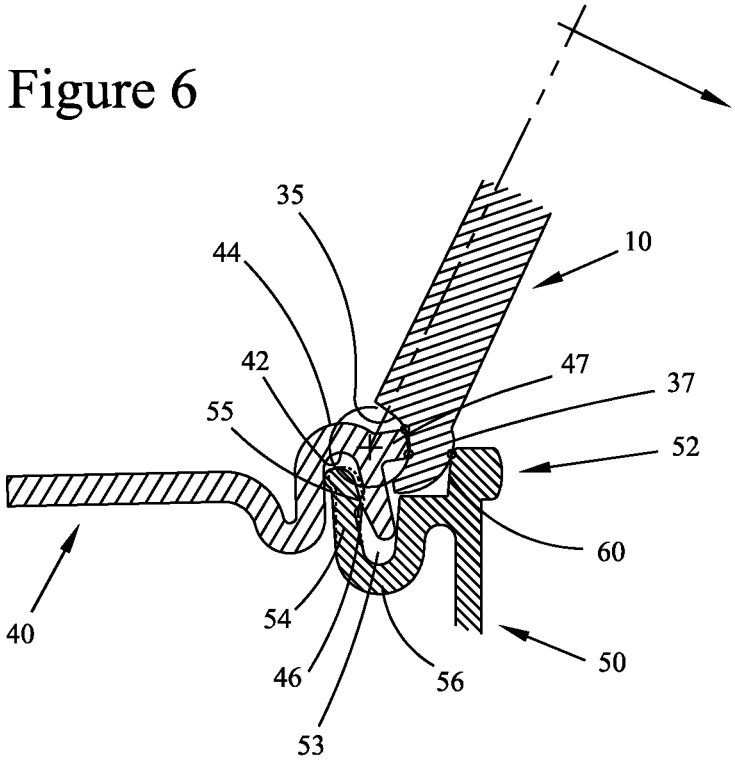
FIG. 6 is a side cross section view of the device for opening container closures shown after approximately 30 degrees rotation of the opener handle.

As the operator continues exerting force on the handle 20 of the opener 10, the lid flange continues to deflect and the container rim assembly 52 also begins to deflect in the area where the flexible finger 54 meets the base 56. FIG. 6 shows the condition of the lid 40 and container 50 and the positioning of the opener 10 in relation thereto, after the opener has been rotated approximately 30 degrees about the effective center of rotation, which corresponds approximately with the center of rotation 36 of the inner cam surface 35. As can be seen in FIG. 6, the plastic lid flange continues deflecting in the area between the roof 44 and outer wall 45, proximal to the outer annular shoulder 47. The container rim assembly also begins to deflect at this point in the area where the flexible finger 54 meets the base 56. The contact points of the outer annular shoulder 47 to the inner cam surface 35 continue to move upwardly along the inner surface, as does the contact point of the rim assembly 52 to the outer cam surface 37. By continuing rotation the opener 10 around the approximate center 36 of the inner cam surface 35 to the point shown in FIG. 6 the vertical lifting force begins to increase thereby continuing to spread the width of the annular channel 42 and pushing upward on the lid 40 to nearly disengage the inwardly extending locking notch 46 from the outwardly protruding locking tab 55.

Figure 7:
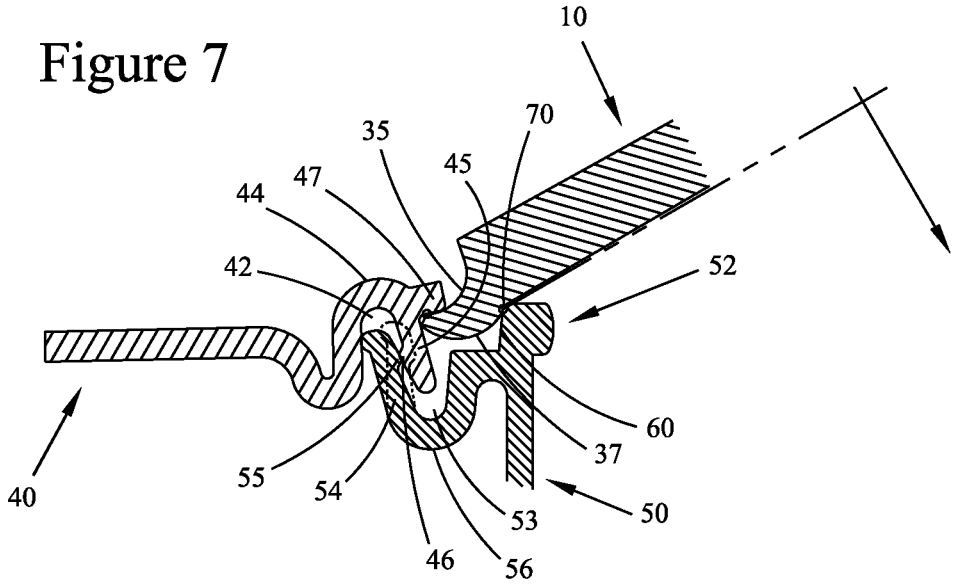
FIG. 7 is a side cross section view of the device for opening container closures shown after approximately 60-70 degrees rotation of the opener handle.

FIG. 7 shows the condition of the lid 40 and container 50 and the positioning of the opener 10 in relation thereto, after the opener has been rotated approximately 60-70 degrees, depending on container tolerances. At this point, the point at which the rim assembly 52 engages the outer cam surface 37 has reached the end of its travel or the end of the hump 39. The point where the outer cam surface meets the bottom of the opener is the fulcrum point 70. As can be seen in FIG. 7, the plastic lid flange continues deflecting in the area between the roof 44 and outer wall 45, proximal to the outer annular shoulder 47, and the container rim assembly continues to deflect in the area where the flexible finger 54 meets the base 56. At this point of rotation, a single contact point between the outer annular shoulder 47 and the inner cam surface 35 exists near the pry edge 31 of the opener, and the outer cam surface has reached the end of its travel such that the rim assembly 52 now engages the fulcrum point 70. By continuing rotation of the opener 10 beyond the point shown in FIG. 7, a primarily vertical lifting force is applied as the opener 10 now rotates around the fixed fulcrum point 70. Also, the inwardly extending locking notch 46 is disengaged from the outwardly protruding locking tab 55 at approximately this point in rotation depending on the exact dimensions of the container and lid due to manufacturer tolerances.

Figure 8:
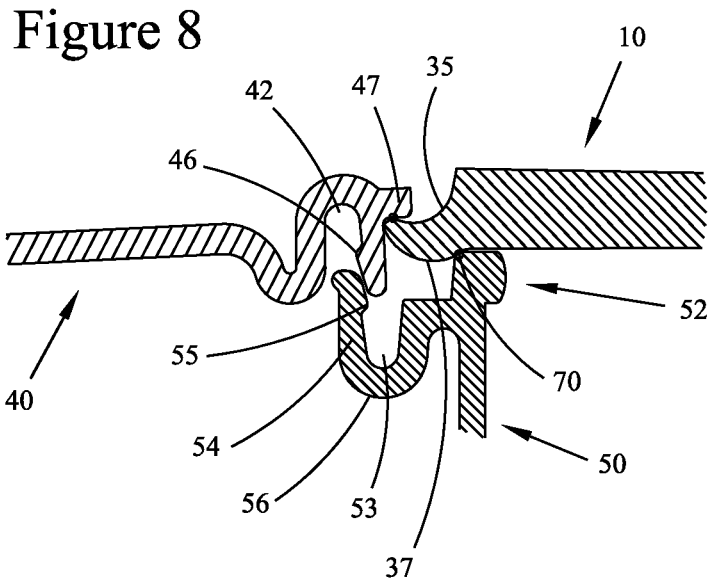
FIG. 8 is a side cross section view of the device for opening container closures shown after rotation of the opener handle to the horizontal position.

FIG. 8 shows the condition of the lid 40 and container 50 and the positioning of the opener 10 in relation thereto, after the opener has been rotated to an approximately horizontal position. At this point, the fulcrum point 70 of the opener 10 still engages the rim assembly 52 and the hump 39 at the end of the outer cam surface 37 keeps the fulcrum point 70 of the opener engaged with the rim assembly 52. Normally reaction forces acting axially along the handle 20 of the opener 10 would try to eject the opener 10 out of the slot between the lid 40 and container 50. However, these reaction forces are offset by the interlocking arrangement of the hump 39, which is hooked inside the rim assembly 52 at the fulcrum point 70. At this point in the rotation of the opener 10, the inwardly extending locking notch 46 has fully disengaged and cleared the outwardly protruding locking tab 55, and the annular channels 42 and 53 of the lid 40 and container 50, respectively, begin to return to their original shapes. At this point, the container and lid flanges have snapped past each other along the circumference of the container and will not reclose after the opener 10 is removed.

Figure 9:
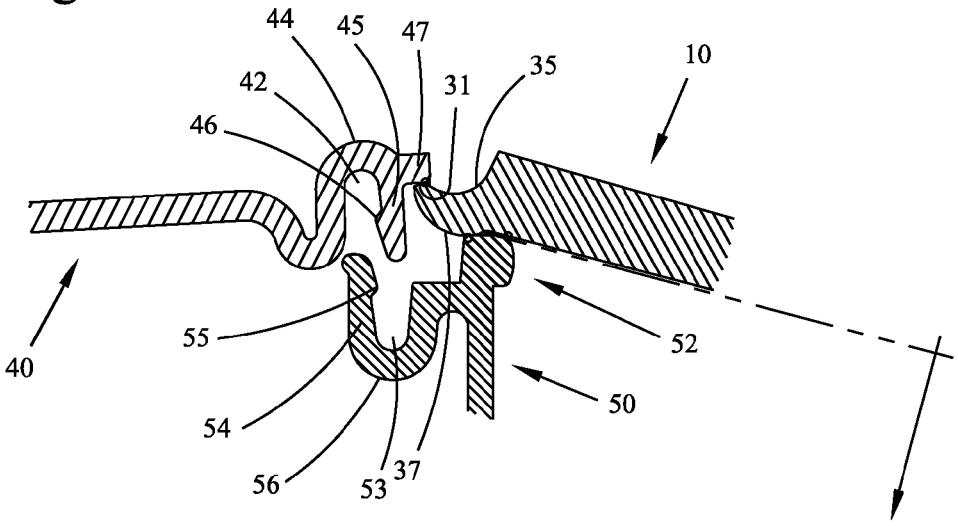
FIG. 9 is a side cross section view of the device for opening container closures shown after the opener handle has been rotated approximately 15 degrees beyond horizontal.

FIG. 9 shows the condition of the lid 40 and container 50 and the positioning of the opener 10 in relation thereto, after the opener has been rotated to approximately 15 degrees beyond the horizontal position. At this point, the lid 30 is fully disengaged from the rim assembly 52 of the container 50 and is being held open for approximately 45-60 degrees of the circumference of the lid 40. The fulcrum point 70 of the opener 10 no longer engages the rim assembly 52 as the hump 39 at the end of the outer cam surface 37 has been compromised and the point of contact with the rim assembly 52 has returned to the outer cam surface 37.

Figure 10:
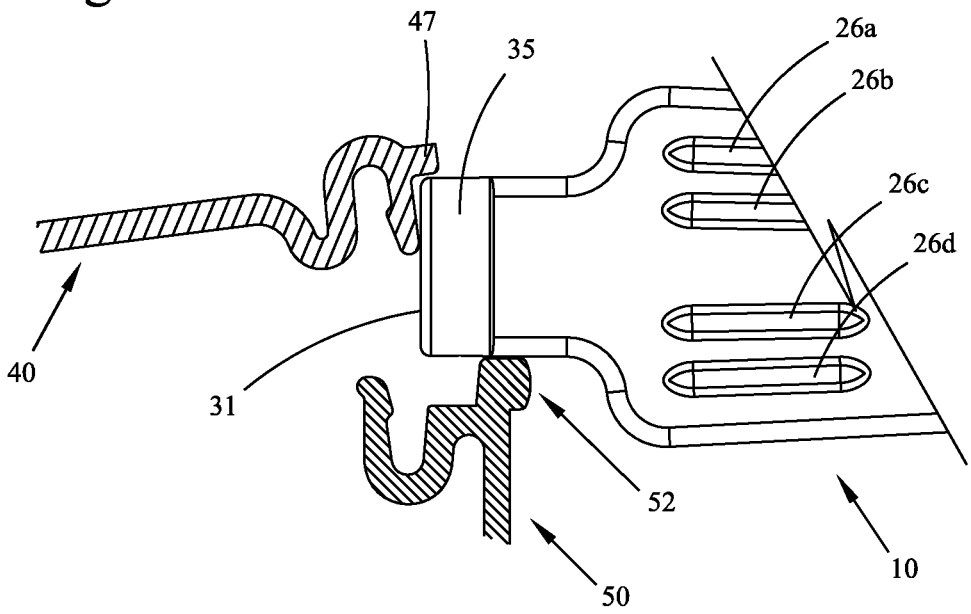
FIG. 10 is a side cross section view of the device for opening container closures shown after the opener has been twisted up to 90 degrees around the central axis of the opener handle.

FIG. 10 shows the condition of the lid 40 and container 50 and the positioning of the opener 10 in relation thereto, after the opener has been twisted up to approximately 90 degrees around the central axis of the handle 20. After rotation of the opener to a point within approximately 10 degrees either side of horizontal (which is shown in FIG. 8), the opener 10 may be twisted up to 90 degrees around the central axis of the handle 20 to provide additional lift. The opener handle 20 is designed specifically to provide a grip, via gripping means 26, at the proper point along the handle 20 to facilitate twisting. The benefit of twisting is significant in providing additional lift to spread the disengaged portion of the inwardly extending locking notch 46 and outwardly protruding locking tab 55 further around the circumference of the container 50, thus requiring fewer re-insertions of the opener 10 to free the entire lid 40. A typical one gallon paint can may be opened with as few as two or three insertions if the handle is twisted at the end of the rotation stroke.

The foregoing is provided for purposes of illustrating, explaining, and describing embodiments of the present invention. The specific components and order of the steps listed above, while preferred is not necessarily required. Further modifications and adaptation to these embodiments will be apparent to those skilled in the art and may be made without departing from the scope or spirit of the invention.

The invention claimed is:

1. A device for opening container closures comprising:

an elongated handle portion having a first end and a second end, and an upper substantially planar surface and a lower substantially planar surface;

an opener portion extending from the first end of the handle portion and having a pry edge located at a free end thereof, wherein the opener portion further includes:

a first side edge and a second side edge defining a width of the opener portion, and an upper surface and a lower surface defining a depth of the opener portion;

an inner cam surface defined by a first radius from a first center of rotation for the opening device, and provided on the upper surface of the opener portion and extending from the pry edge toward the first end of the handle portion;

an eccentric outer cam surface defined by a second radius from a second center of rotation for the opening device, and provided on the lower surface of the opener portion and extending from the pry edge toward the first end of the handle portion, wherein the eccentric outer cam surface projects below a lower surface of the opener portion forming a hump;

a fulcrum point located at a point where the lower surface of the opener portion meets a second end of the eccentric outer cam surface; and wherein the width of the opener portion is greater than the depth of the opener portion; and said first center of rotation for the opening device defining said inner cam surface and said second center of rotation for the opening device defining said outer cam surface are both located below said upper substantially planar surface.

2. The device for opening container closures of claim 1, wherein the elongated handle portion and opener portion are a unitary piece of material.

3. The device for opening container closures of claim 2, wherein the handle portion and opener portion are formed from a plastic material.

4. The device for opening container closures of claim 3, wherein the plastic material has a tensile strength of at least 15,000 pounds per square inch.

5. The device for opening container closures of claim 3, wherein the plastic material is 30% glass-filled nylon.

6. The device for opening container closures of claim 1, further comprising a widened region of the elongated handle portion proximal to the first end thereof.

7. The device for opening container closure of claim 6, further comprising gripping means on a surface of the elongated handle portion in said widened region.

8. The device for opening container closures of claim 7, wherein the gripping means comprises a plurality of ridges protruding from an upper surface of the elongated handle portion in said widened region.

9. The device for opening container closures of claim 1, wherein the pry edge of the opener section has a blunt end.

10. The device for opening container closures of claim 9, wherein the blunt end of the pry edge has a thickness of greater than 0.025 inches.

11. The device for opening container closures of claim 10, wherein the blunt end of the pry edge has a thickness of 0.040 inches.

* * * * *